United States Patent [19]

Stemmle

[11] Patent Number: 4,858,909

[45] Date of Patent: Aug. 22, 1989

[54] SHEET TRANSPORTING APPARATUS

[75] Inventor: Denis J. Stemmle, Webster, N.Y.

[73] Assignee: Xerox Corporation, Stamford, Conn.

[21] Appl. No.: 176,121

[22] Filed: Mar. 31, 1988

[51] Int. Cl.[4] ..... B65H 29/00

[52] U.S. Cl. ..... 271/184; 271/186; 271/207; 271/314

[58] Field of Search ..... 271/272, 273, 274, 184, 271/186, 65, 314, 207, 11

[56] References Cited

U.S. PATENT DOCUMENTS

| | | | |
|---|---|---|---|
| 3,659,838 | 5/1972 | Davis | 271/11 |
| 4,054,285 | 10/1977 | Stange et al. | 271/186 |
| 4,078,789 | 3/1978 | Kittredge et al. | 271/65 |
| 4,256,299 | 3/1981 | Hogenson | 271/262 |
| 4,300,757 | 11/1981 | Koiso et al. | 271/207 |

FOREIGN PATENT DOCUMENTS 1475094 11/1974 United Kingdom .

*Primary Examiner*—Joseph J. Rolla
*Assistant Examiner*—Mona C. Beegle
*Attorney, Agent, or Firm*—William A. Henry, II

[57] ABSTRACT

Sheet transporting apparatus including a pair of rollers (13, 14) forming a sheet transporting nip (12), and adapted, when in an initial position (FIG. 1*a*), to engage the leading edge (17) of a sheet (11) delivered thereto, and subsequently to produce an orbital motion of the rollers one about the other so as to progressively change the direction of motion of the sheet while the sheet is advancing through the nip (FIGS. 1*b*–1*d*).

16 Claims, 5 Drawing Sheets

SHEET TRANSPORTING APPARATUS

This invention relates to a sheet transporting apparatus particularly, although not exclusively, useful for delivering the copy sheets in a copying machine. The apparatus is of the kind which includes a pair of rollers forming a sheet feeding nip, and may advantageously be used in conjunction with a sheet receiving means for receiving successive sheets fed from the nip.

Such a sheet transporting apparatus is commonly used in xerographic copiers, in conjunction with stack receiving means comprising a tray which receives copy sheets fed out in a generally horizontal direction, the tray often being inclined either upwardly or downwardly in the direction of sheet feed. The angle of inclination is usually less than 45°. Typically, the copy sheets are fed out of the processor of a copier in a face-up orientation, and will frequently leave the processor with their imaged faces in the order 1—n, assuming an input sequence of documents being copied which are copied in that order. A simple catch tray arranged to receive each copy in turn, face-up, will thus put sheet 1 into the tray first, followed by the succession of sheets on top of each other as far as sheet n, thereby forming a stack with sheet 1 on the bottom and sheet n on the top. The stack removed from the tray is accordingly in reverse order, i.e. n—1 compared with the input sequence (1—n). As will be seen, one way of obtaining an output stack with 1—n sheet order is to invert each sheet so that it is placed face-down in a catch tray. The complete stack in the output tray will then be a face-down stack, which, when inverted as a whole, to make it a face-up stack, will be a 1—n stack like the input stack.

Because of the inconvenience of an output stack in n—1 order, various ways have been tried to solve the problem of providing an output stack in 1-n order, involving either sheet inversion, as mentioned above, or a stacking method which involves feeding the sheets successively into the bottom of a stack.

One example of a sheet inverter for copy sheets discharged from a copier is described in U.S. Pat. No. 4,300,757, in which sheets emerging horizontally from between fixed-axis feed rollers at the discharge port of a copying machine are deflected downwardly by a fixed deflector. The downwardly deflected leading edge of a sheet falls on to a catch tray, and the trailing edge continues in the sheet feed direction so as to invert the sheets onto the catch tray.

Another example of a sheet inverter in a copier is described in UK Pat. No. 1,475,094. Here a pair of feed rollers are mounted in a frame, to enable rotation of the entire roller pair about an axis through the nip. A sheet enters the nip, the rollers stop feeding, the frame is rotated through 180°, and the rollers (not rotating in the opposite sense) feed the inverted sheet out in the original feed direction. Other examples of inverters include U.S. Pat. No. 4,054,285 which includes a fixed tri-roll unit for inversion purposes and U.S. Pat. No. 4,078,789 which discloses a fixed tri-roll inversion unit having an input nip that drives sheets downward into an inversion chute where the sheets are driven upwards and out of the chute by a fluid stream in cooperation with an exit nip of the tri-roll unit.

These known sheet inversion techniques are either unreliable, or involve rather complex mechanisms. Furthermore, they are not suitable for use in copiers which handle a range of copy sheet sizes.

Another problem encountered with a sheet transporting apparatus which is arranged to collect sheets in a tray is the difficulty of feeding sheets of different lengths into the tray. If the sheet transporting arrangement which feeds sheets into the tray is sufficiently far from the end stop of the tray to accommodate the longest sheets to be fed, then shorter sheets to be fed may fall short and may not reach the end stop, or may collide with the trailing edges of previously stacked sheets, even if, as is commonly the case, the catch tray slopes 'downhill' from the sheet entry point. Conversely, if the sheet transporting arrangement is closer to the end stop, so that shorter sheets are stacked correctly, then it will not be possible to stack sheets longer than a certain length. In order to accommodate the range of sheet sizes in common use, it is possible to use two or more sheet transporting arrangements with a deflector plate between them. All sheets are fed by a first set of feed rollers, and shorter sheets are also fed by a second set. Longer sheets are deflected by the deflector plate after the sheet has passed through the first set of rollers, thereby by-passing the second set. The problem with this arrangement is that although it works well for sheets of two lengths related to the positions of the two sets of rollers, it is not so reliable for intermediate lengths. Typically, therefore, additional sets of feed rollers and deflectors are used to accommodate multiple sheet sizes. This makes the mechanism more complex and expensive and less reliable. Another way of accommodating the normal range of sheet sizes is to use 'uphill' stacking, i.e. to feed the sheets upwards onto a sloping tray. Uphill stacking is not suitable, however, when the leading edges of the stacked copies must be registered, for example for subsequent duplex imaging or stapling. In practice, both of these approaches require additional components and additional space compared with using a conventional sheet transporting arrangement to feed sheets into a generally horizontal tray.

The present invention is intended to provide a relatively simple, yet reliable, way of forming a 1—n output stack from a 1—n input sequence as well as to enable a range of sheet sizes to be stacked reliably into a conventional tray.

According to the present invention, there is provided a sheet transporting apparatus including a pair of rollers forming a sheet transporting nip, and adapted, when in an initial position, to engage the leading edge of a sheet delivered thereto, and means arranged to produce an oribital motion of the rollers one about the other so as to progressively change the direction of motion of the sheet while the sheet is advancing through the nip.

In one preferred apparatus in accordance with the invention, the nip between the rollers, in its initial position, is oriented so as to receive a sheet delivered thereto in a generally horizontal direction, and at the position in said orbital motion furthest from the initial position is oriented so that it is advancing the sheet generally vertically downwards. In this form, the apparatus is suitably used in conjunction with a generally vertical sheet receiving tray to provide a sheet inverting stacker. In a variation of this form of apparatus, the sheet receiving tray is inclined closer to a horizontal orientation (preferably uphill) and the nip makes an orbital motion to a position somewhere between 90° and 180° from its initial position, thereby inverting the sheets into a generally horizontal stack.

In another preferred apparatus in accordance with the invention, the sheet transporting apparatus is used in conjunction with a generally horizontal sheet receiving tray to provide a sheet stacking apparatus capable of reliably stacking sheets over a wide range of sheet lengths without any adjustments being needed to the locations of the rollers or the tray.

The apparatus of the invention is a simple, reliable, and compact apparatus, and has very good tolerance to a wide range of paper weights and sizes.

A sheet transporting apparatus in accordance with the invention will now be described, by way of example, with reference to the accompanying drawings, in which:

FIGS. 1*a* to 1*d* are diagrammatic cross sectional views illustrating the operation of an inverting sheet stacking apparatus incorporating the invention;

Figures 1A, 1B, 1C, 1D:
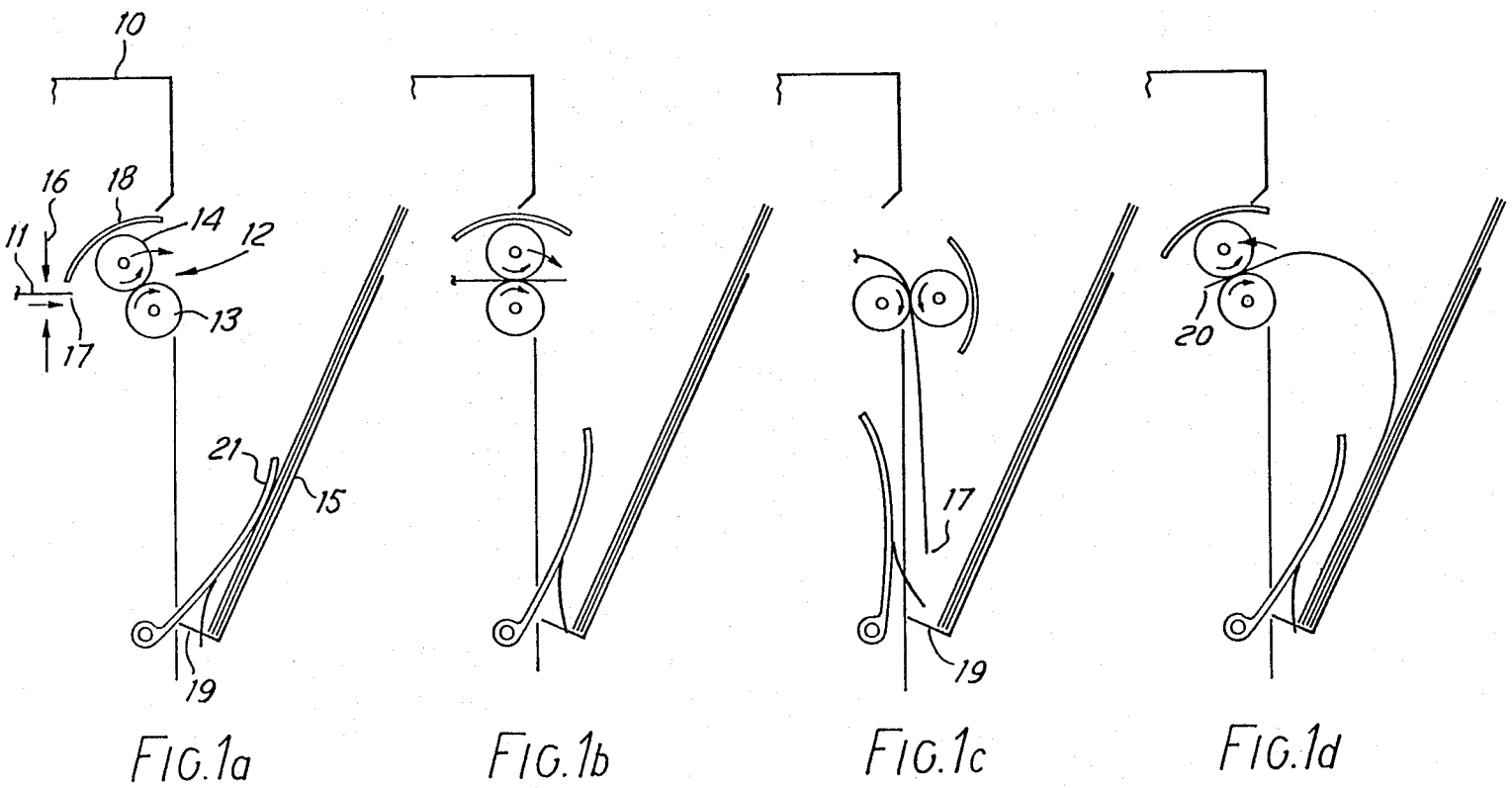

Referring to FIGS. 1*a* to 1*d*, a copying machine 10 such as a xerographic copying machine, delivers copy sheets 11 through the sheet feeding nip 12 of a pair of feed rollers 13, 14 into a compiler tray 15. The lower roller 13 is a driven roller, and the upper roller 14 is an idler. The copy sheets 11 are delivered, face-up, in succession towards the nip 12 in a generally horizontal orientation. A sensor 16 (FIG. 1*a*), such as a micro switch or an electro-optic sensor, detects the leading edge 17 of the sheet 11 and activates a cam-operated orbiting roller mechanism or other suitable drive mechanism such as the belt drive to be described below. This mechanism causes the upper roller 14 to move angularly around the lower roller 13 in the clockwise direction, in orbital fashion. This orbital motion takes place during sheet feeding by the rollers, the nip 12 producing generally horizontal feeding of the sheet 11 at its leading edge passes between the rollers, as shown in FIG. 1*b*. The shroud 18 of the upper roller 14 moves with the roller throughout.

The feed rollers continue to feed the sheet 11 as the upper roller 14 continues its orbital motion until the nip 12 is substantially vertical, as shown in FIG. 1*c*, at which point the sheet 11 is being fed substantially directly downwards. The upper roller 14 dwells in this position (due to the configuration of the cam mechanism) until the leading edge 17 of the sheet 11 contacts the base 19 of tray 15 (FIG. 1*d*). At this point, the orbital motion of the upper roller 14 (and shroud 18) is reversed, so that its axis starts to move anti-clockwise around the lower roller, although the lower roller 13 continues to be driven in the sheet feed direction thereby forming a buckle in the sheet 11 as seen in FIG. 1*d*. The trailing edge 20 of sheet 11 is fed through the nip 12 as the roller 14 returns towards its starting position, thereby directing the trailing edge of the sheet generally horizontally towards the upper part of the tray, effectively "peeling" the sheet 11 into the tray 15.

The fact that the leading edge of the sheet is positively fed into the tray 15, and not dropped, and that the trailing edge if fed with the peeling motion that tends to "lay" the sheet into the tray, produces excellent registration of stacked sheets in the tray. It also enables a wide range of sheet sizes and paper weights to be handled without risk of collisions or paper jams.

In order to assist the stack in the tray 15 in maintaining its vertical orientation, a stack corrugation tongue 21 is pivotally mounted adjacent the base 19 of the tray 15, and is moved into and out of pressing engagement with the sheets in tray 15 by a driving arrangement linked with the mechanism causing the orbital motion of the upper roller 14. When the upper roller 14 is in its initial position (FIG. 1*a*) the stack corrugation tongue 21 presses the sheets in tray 15 towards the rear of the tray, the tray and the tongue being so shaped as to form a vertically-extending corrugation in the sheets. This provides beam strength to the stack, which enables the stack to stand on its edge. As the orbiting motion of the upper roller 14 commences (FIG. 1*b*) the stack corrugation tongue 21 moves away from the tray, and achieves maximum displacement from the tray when the nip 12 is substantially vertical (FIG. 1*c*). This enables the fed sheet 11 to be placed unhindered into the tray. As the upper roller 14 returns towards its initial position (FIG. 1*d*) the stack corrugation tongue 21 is moved back into contact with the stack so as to corrugate the most recently fed sheet 11.

Also driven from the mechanism which causes the orbital motion of the upper roller is a side tamping arm 22 (FIGS. 3, 4) which is activated after a sheet has been discharged from the nip 12 but before the stack corrugation tongue 21 contacts the set. This action accurately aligns the vertical edges of the stack of sheets in the tray 15.

Figure 2:
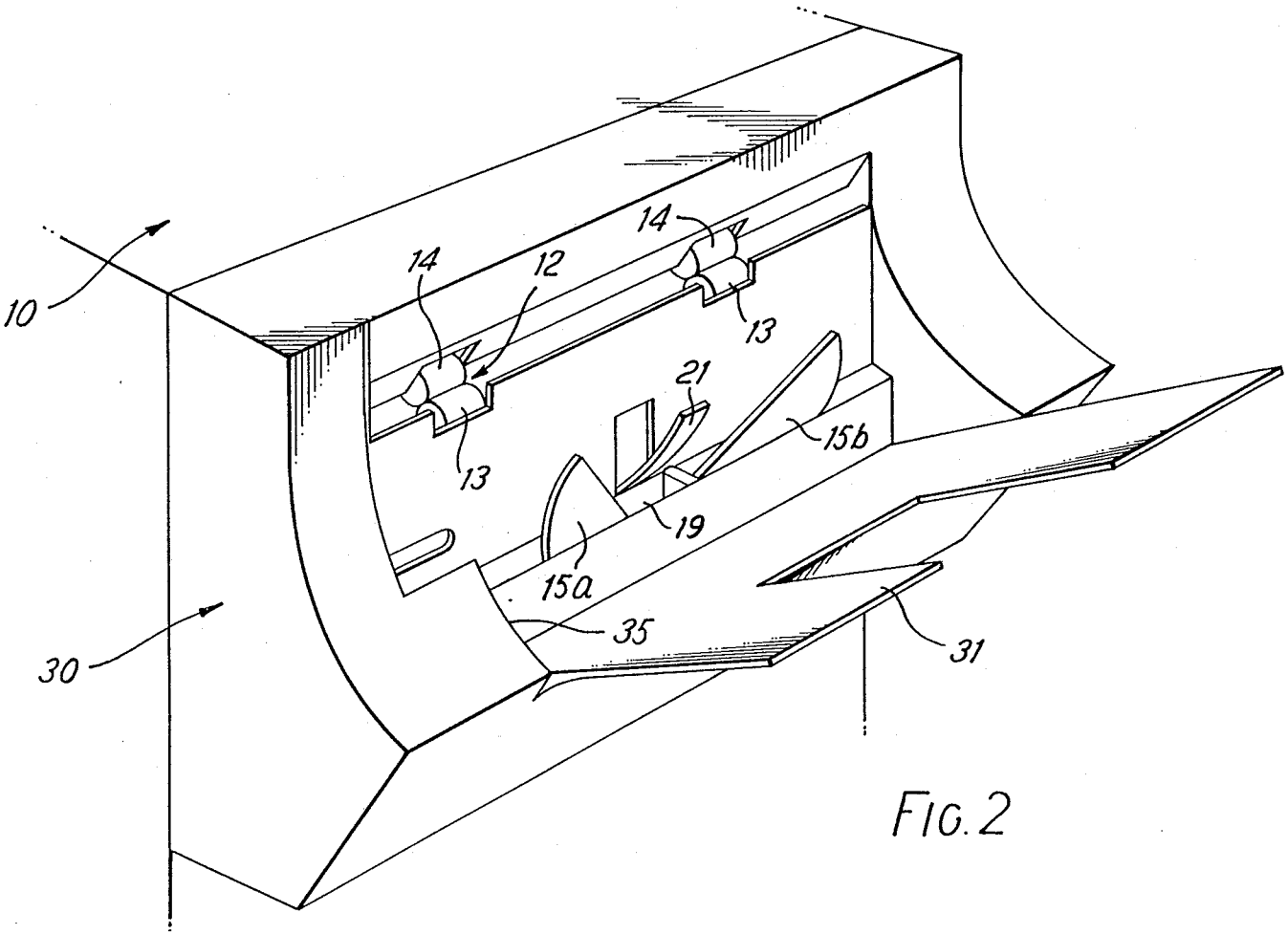
FIG. 2 is a perspective view of an inverting sheet stacking apparatus incorporating the invention.
Figure 3:
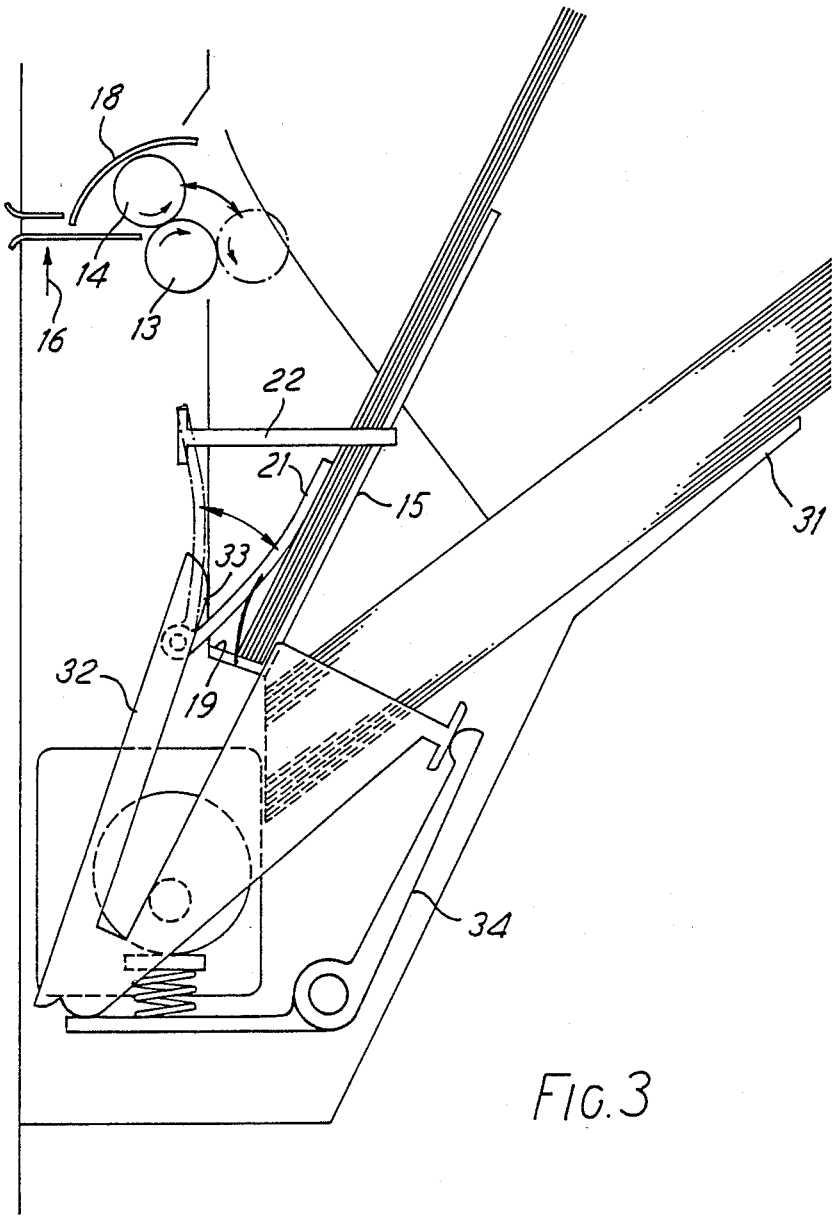
FIG. 3 is a diagrammatic cross sectional side view of the apparatus of FIG. 2.
Figure 4:
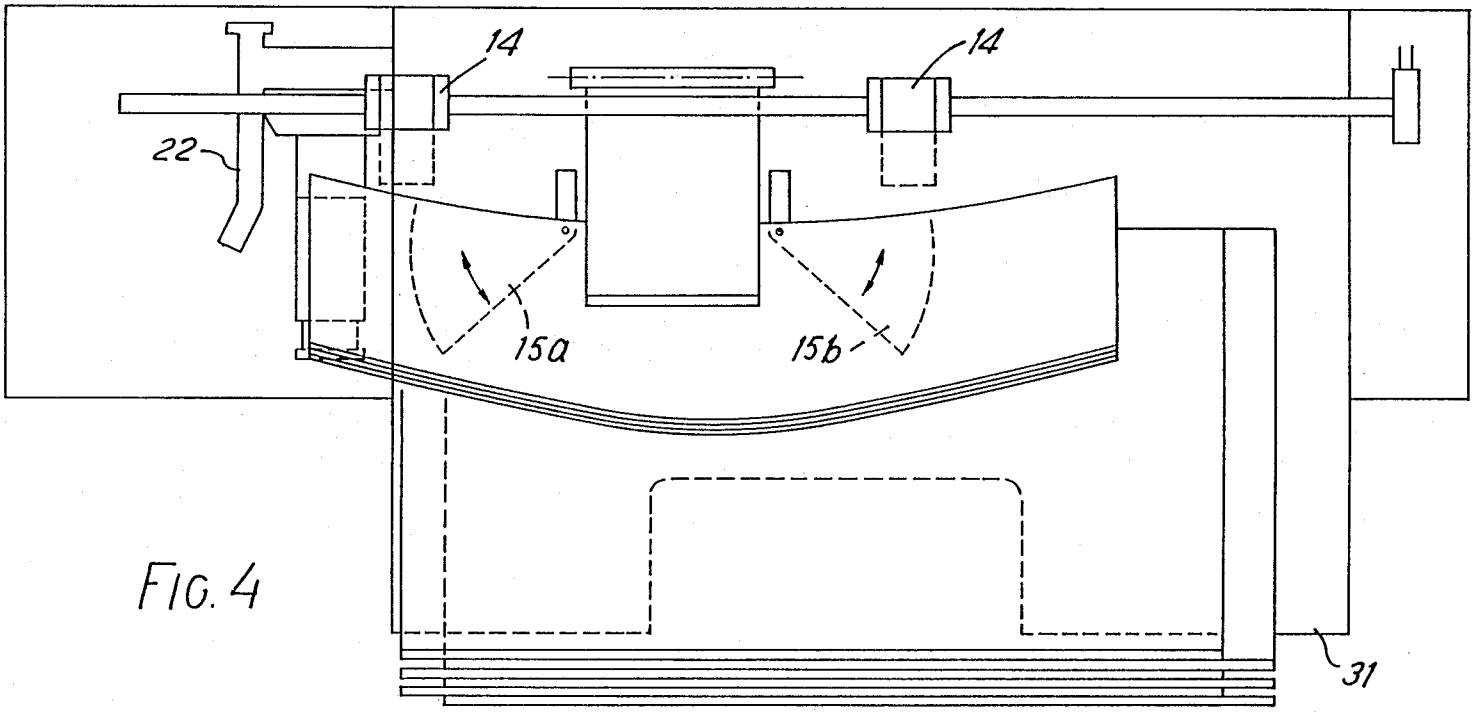
FIG. 4 is a diagrammatic plan view of the apparatus of FIG. 2.

Referring now to FIGS. 2, 3 and 4, the sheet stacking apparatus of the invention is incorporated in a finisher station 30 for a xerographic copier 10. In this circumstance, the compiler tray 15 of FIG. 1 is represented by two fold-down partial trays constituted by set support arms 15*a*, 15*b*. The corrugations produces by stack corrugation tongue 21 are formed by pressing the tongue into the space between the two set support arms 15*a*, 15*b*. Once a compiled set has been completed, set support arms 15*a*, 15*b* are folded down, causing the set to drop into a larger capacity catch tray 31. An offsetting function can be introduced by causing the tamping arm to move alternate compiled sets of copies by a greater distance than the other sets.

Referring to FIG. 4, an incoming sheet arrives with its registration edge at position 1, and is moved by the tamping arm 22 to position 2. Compiled sets are then passed, prior to discharge, to offset positions 3 and 4 alternately.

As part of the finisher function, a stapler 32 may be provided adjacent the lower corner of the compiler tray into which the copy sheets are registered. Thus when stapled sets of copies are required, as each set is compiled the stapler is activated, and the tamper arm is then moved so as to push the stapled set out of the stapler throat to one of the two offset positions 3 or 4. The stapler is arranged, as seen in FIG. 3, so that its anvil 33 is on the machine side of the compiler tray, with the moving parts and the driving mechanism 34 located within a housing 35 (FIG. 2).

Figure 5:
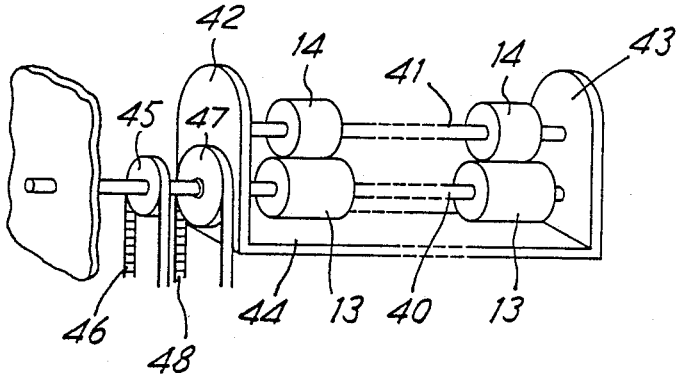
FIG. 5 is a partial perspective view of an orbiting roller arrangement suitable for use in the apparatus of the invention.

An example of a driving arrangement for the orbiting rollers is illustrated in FIG. 5. Driven rollers 13 and idler rollers 14 are carried respectively on drive shaft 40 and idler shaft 41. Shaft 40 is journaled for rotation in end members 42 and 43 of support frame 44, and is driven by drive pinion 45 which in turn is driven by, for example, drive belt 46. Thus, on operation of drive belt 46, the drive rollers 13 rotate, causing rotation of the idler rollers 14 by frictional engagement, the idler rollers 14 either being journaled for rotation on idler shaft 41, or being fixed to shaft 41 which is then journaled for rotation in end members 42 and 43 of frame 44. In order to produce orbital motion of the idler rollers 14 about the axis of driven rollers 13, the frame 44 is caused to make angular movements about the axis of drive shaft 40. Angular movement of the frame 44 is achieved by means of a drive pinion 47 secured to end member 42, the drive shaft 40 being journaled for rotation relative to the drive pinion 47. A drive belt 48 engages pinion 47, and is operated to cause angular motion of the pinion 47, and hence the frame 44.

Figure 6:
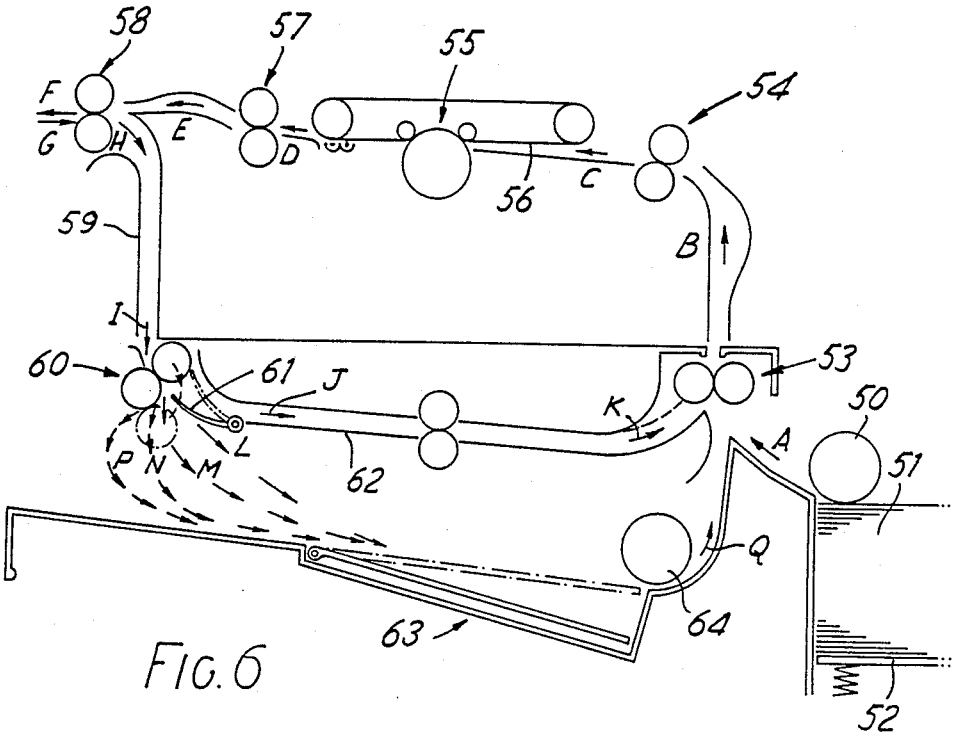
FIG. 6 is a diagrammatic representation of part of a xerographic copying machine which has a duplex copying facility utilising a duplex buffer tray incorporating the invention.

Referring now to FIG. 6, a xerographic copying machine which has a duplex copying facility uses a buffer tray that incorporates a sheet transporting apparatus according to the invention. FIG. 6 shows (diagrammatically) only those components which are involved in the movement of copy paper sheets through the apparatus. A copy sheet is fed, by a feed roller 50, from a stack 51 of sheets supported on an elevating stack carrier 52. The sheet, as indicated by arrow A, is guided to a pair of primary transport rollers 53, and then, as indicated by arrow B is guided to a second pair of transport rollers 54. The transport rollers 54 convey the sheet (arrow C) to a xerographic transfer station 55 where a developed electrostatic latent image is transferred from a photoreceptor belt 56 on to the upper surface of the copy sheet. The sheet carrying the transferred image, as indicated by arrow D, then passes through a fuser 57 comprising a heated roller and a backup roller. The fuser 57 fixes the developed image on to the upper surface of the copy sheet, which is then guided to output rollers 58, as indicated by arrow E.

If the image is to be formed on only one side of the copy sheet (i.e. a simplex copy), the sheet is transported completely through the output rollers 58, as shown by arrow F, and into a suitable output tray (not shown). If, however, images are to be formed on both sides of the sheet (i.e. a duplex copy), then the sheet is recirculated so that it can receive an image on its other side, as will now be described.

For duplex copying, instead of the sheet passing completely through output rollers 58, it is stopped just before its trailing edge arrives at the nip between the output rollers. The output rollers are then reversed, so that the sheet passes back between them, as indicated by arrow G. The geometry of the output rollers and the surrounding sheet guiding surfaces is such that on reversal of the output rollers, the sheet is fed back into a lower guide throat 59, as indicated by arrow H, rather than towards the fuser 57. The sheet then passes (arrow I) into the nip of a pair of transport rollers 60 which constitute a sheet transporting apparatus in accordance with the invention.

When a single duplex copy is to be produced from an original, the axes of transport rollers 60 remain stationary, and by means of a gate 61 the sheet is guided (arrow J) along sheet guide 62 towards primary transport rollers 53 (arrow K). As the sheet approaches rollers 53, its imaged face is uppermost, so that on its second pass through the xerographic system (arrows B, C, D and E) its imaged face is lowermost, so that it can receive an image on its blank face. The sheet, carrying images on both faces after the second pass, is conveyed completely out of the machine by output rollers 58 (arrow F) and deposited in the output tray.

In the case where multiple copies are to receive duplex images, in a mode where all the first sides of a set of copy sheets are imaged first, followed by all the second sides, the sheets are held following the imaging of the first sides in a duplex buffer tray 63. To achieve this, the gate 61 is raised, as shown in broken outline, so that the sheets are fed into the buffer tray (arrows L) for sheets less than a predetermined length, the axes of the rollers 60 remain stationary throughout the feeding of sheets into the buffer tray 63. A stack of sheets is formed in the buffer tray 63, and an elevating base, which brings the top sheet in the stack into engagement with buffer tray feed roller 64. Sheets fed by feed roller 64 are guided (arrow Q) up to primary feed rollers 53 to make a second pass in the fashion just described for the single copy duplex mode.

Finally, for sheets longer than the predetermined length, instead of the axes of the transport rollers 60 being held stationary throughout the feeding of a sheet, the rollers are first held stationary, and then caused to make an orbiting motion, as previously described herein, with the axis of the idler roller (the upper roller as seen in FIG. 6) making a clockwise orbital motion around the drive roller (the lower roller), so that the sheet is laid down onto the tray somewhat as indicated by arrows M, N and P, with arrow P representating the path followed by the longest sheets. In this way, sheets of a wide range of lengths can be deposited in the buffer tray, and the sheets can be longer than the distance between the end of the buffer tray nearest feed roller 64 and the nip between the rollers 60. Thus, as a long sheet is fed between rollers 60, its leading edge is first fed into contact with the end of buffer tray 63 just below feed roller 64. At around this time, the orbiting motion of rollers 60 is commenced, so that the trailing edge of the sheet is guided first generally downwards towards the tray 63, and eventually in a direction away from the far end of the tray 63, as indicated by arrows P when the orbiting roller is in the broken line position shown. The effect is a "peeling" motion of the sheet onto the tray. Sheets considerably longer than the tray can be deposited onto the tray, without the need for an unduly long paper path, and without the need for additional deflectors or feed rollers. After deposition of a sheet, the orbiting motion of the rollers 60 is reversed to return the nip to its original position prior to the arrival of the leading edge of the next sheet to be stacked.

What is claimed is:

1. Sheet transporting apparatus including:

a pair of rollers forming a sheet transporting nip, and adapted, when in an initial position, to engage the leading edge of a sheet delivered thereto, and means arranged to produce an orbital motion of the rollers one about the other in an orbiting mode so as to progressively change the direction of motion of the sheet while the sheet is advancing through the nip, said rollers being adapted for additionally transporting sheets in a mode in which the axes of the two rollers are in line within a vertical plane therethrough, and wherein the sheet transporting apparatus operates only in the mode in which the axes of the two rollers are within a vertical plane for sheets of less than a predetermined length, and then operate in the orbiting mode for sheets at least equal to the predetermined length.

2. The apparatus of claim 1 including means for moving the rollers in said orbital mode to produce said orbital motion about the axis of one of the rollers.

3. The apparatus of claim 1, wherein the rollers transport a sheet initially in said mode in which the axes of the rollers are in line within a vertical plane therethrough and then in the mode in which the rollers perform said orbital motion.

4. The apparatus of claim 1 wherein the nip, in its initial position, is oriented so as to receive a sheet delivered thereto in a generally horizontal direction, and at the position in said orbital motion furthest from the initial position is oriented so that it is advancing the sheet in substantially the opposite direction to the initial sheet delivery direction.

5. The apparatus of claim 4 wherein the rollers deposit sheets in a sheet receiving tray, and wherein the distance between the nip and the far end of the tray, measured in the initial direction of sheet motion into the nip, is less than the length of the longest sheets which can be accommodated by the tray, whereby the trailing edges of said longest sheets, after they have been deposited in the tray, extend beyond the nip in a direction opposite to said initial direction of sheet motion.

6. The apparatus of claim 1, wherein the direction of the orbital motion of the rollers in said orbiting mode is reversed during the transporting of a sheet.

7. The apparatus of claim 6 wherein the initial position of said rollers and the position of said rollers at the end of said orbital motion is such as to invert a sheet transported thereby.

8. The apparatus of claim 7 wherein the nip, in its initial position, is oriented so as to receive a sheet delivered thereto in a generally horizontal direction, and at the position in said orbital motion furthest from the initial position is oriented so that it is advancing the sheet generally vertically downwards.

9. An apparatus for transporting and stacking sheets including:

a pair of rollers forming a sheet transporting nip, and adapted, when in an initial position, to engage the leading edge of a sheet delivered thereto;

means arranged to produce an orbital motion of the rollers one about the other in an orbiting mode so as to progressively change the direction of motion of the sheet while the sheet is advancing through the nip, said rollers being adapted for additionally transporting sheets in a mode in which the axes of the two rollers are in line within a vertical plane therethrough, and wherein the sheet transporting apparatus operates only in the mode in which the axes of the two rollers are within a vertical plane for sheets of less than a predetermined length, and then operate in the orbiting mode for sheets at least equal to the predetermined length, and a sheet receiving tray adapted to receive sheets transported by the rollers.

10. The apparatus of claim 9 wherein said sheet receiving tray is generally horizontal.

11. The apparatus of claim 9 wherein said sheet receiving tray is generally uphill relative to the initial sheet delivery direction.

12. The apparatus of claim 9 wherein said sheet receiving tray is generally downhill relative to the initial sheet delivery direction.

13. The apparatus of claim 9 wherein said sheet receiving tray is generally vertical.

14. An apparatus for transporting and stacking sheets including:

a pair of rollers forming a sheet transporting nip, and adapted, when in an initial position, to engage the leading edge of a sheet delivered thereto;

means arranged to produce an orbital motion of the rollers one about the other so as to progressively change the direction of motion of the sheet while the sheet is advancing through the nip, and wherein said rollers are arranged such that the direction of the orbital motion is reversed during the transporting of a sheet, and wherein the initial position of said rollers and the position of said rollers at the end of said orbital motion are such as to invert a sheet transported thereby, and wherein said nip, in its initial position, is oriented so as to receive a sheet delivered thereto in a generally horizontal direction, and at the position in said orbital motion furthest from the initial position is oriented so that it is advancing the sheet generally vertically downwards; and a sheet receiving tray inclined to the vertical, the tray having a lower end generally vertically below the rollers and an upper end spaced away from the rollers in said generally horizontal direction, whereby the leading edge of a sheet is transported down into the lower end of the tray, with the remainder of the sheet being deposited onto the tray in inverted configuration.

15. The apparatus of claim 14 wherein said rollers comprise a driven roller and an idler roller.

16. The apparatus of claim 15 wherein the driven and idler rollers are mounted on shafts supported in a frame, the driven roller being mounted for rotation relative to the frame and the frame being mounted for rotation about the axis of the driven roller so as to produce said orbital motion.

* * * * *